US006737633B2

(12) United States Patent
Francke

(10) Patent No.: US 6,737,633 B2
(45) Date of Patent: May 18, 2004

(54) SYSTEM AND METHOD FOR IDENTIFYING OVERLAPPING MAIL PIECES

(75) Inventor: Jürgen Francke, Berlin (DE)

(73) Assignee: Siemens AG, Munich (DE)

( * ) Notice: Subject to any disclaimer, the term of this patent is extended or adjusted under 35 U.S.C. 154(b) by 73 days.

(21) Appl. No.: 10/302,912

(22) Filed: Nov. 25, 2002

(65) Prior Publication Data

US 2003/0071200 A1 Apr. 17, 2003

Related U.S. Application Data

(63) Continuation of application No. PCT/DE01/01762, filed on May 9, 2001.

(51) Int. Cl.[7] ..... G06M 7/00; B65H 5/00
(52) U.S. Cl. ..... 250/221; 271/263; 209/606
(58) Field of Search ..... 250/221, 222.1, 250/223 R; 271/263, 265.04; 902/16; 209/606, 900; 340/555–557

(56) References Cited

U.S. PATENT DOCUMENTS 6,170,816 B1 * 1/2001 Gillmann et al. ..... 271/265.02
6,375,182 B1 * 4/2002 Sting et al. ..... 271/265.02
6,389,327 B1 * 5/2002 Thiel ..... 700/227

* cited by examiner

*Primary Examiner*—Stephone B Allen
(74) *Attorney, Agent, or Firm*—Jacob Eisenberg; Siemens Schweiz

(57) ABSTRACT

The present invention comprises a system and method for detecting overlapping mail pieces wherein a lead mail piece edge is diverted from the regular conveyance and a light barrier is used to detect if another mail piece follows. Specifically, the diverted mail piece may break or interrupt a light barrier thereby triggering a counter which determines the time between the interruption and subsequent interruption. If the time is less than that required for the diverted mail piece to pass the light barrier, then an overlapping mail piece is present.

16 Claims, 7 Drawing Sheets

SYSTEM AND METHOD FOR IDENTIFYING OVERLAPPING MAIL PIECES

CROSS REFERENCE TO RELATED APPLICATIONS

The present application is a continuation of international application number: PCT/DE01/01762, filed May 9, 2001; and claims priority to German patent application DE 10027874.4, filed Jun. 6, 2000; both of which are incorporated herein by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to the field of postal automation and handling and in particular to the detection of overlapping mail pieces conveyed during the postal handling process. The mail pieces at issue are, generally, flat and flexible, and transported in a sequence by a conveyor belt and the like.

Sorting devices incur problems when sorting mail pieces, namely, dual subtraction errors or the unintended removal of an overlapping mail piece along with the intended removal of the mail piece being overlapped. The intended mail piece is usually the leading mail piece. Numerous reasons exist for overlapping mail pieces and dual subtraction, including friction between the two mail pieces and over-protruding leading mail pieces. By this error, the overlapping mail pieces are unintendedly sorted to usually wrong locations within the mail handling system. In addition, the error distribution rate increases and an increase probability of mechanical interference and/or failure caused by the overlapping mail piece may result. One result to the above problem is to identify overlapping mail pieces and treat them as rejected mail items. Accordingly, the aforementioned results of this problem may be avoided.

One proposed solution includes the identification of overlapping mail pieces. One form of identification includes applying a pattern, such as a bar code, to the length of the mail piece and/or scannable traces on the front and back side of the mail piece. The pattern is then scanned for interruptions, the interruptions indicating a blockage of the scan and therefore an overlap. This solution requires the initial steps of applying the pattern or trace onto the mail piece. In a second step, the mail items are set aside for more precise distribution and then overlaps may be identified. By this solution it is not possible to detect overlaps in a first mail run through a distribution plant given that this occurs prior to the application of the pattern or trace. The high mechanical expenditure which has to be driven to flex-level or to bend the mail items in order to detect possible pattern or trace interruptions is also a disadvantage of this solution. Another disadvantage is that the pattern or trace may only be applied onto portions of mail items which are not covered up by shipping straps.

Another solution is proposed in EP 028 056 which sets out an apparatus wherein edges of mail items are detected by light sensors and diagonal illumination. With the help of a control switch it is then determined if a dual subtraction exists. This method has a high error rate due to the varying condition of the surface of the mail items arising for example from dirt accumulations.

A still further solution is proposed in U.S. Pat. No. 3,578,315 which also makes use of light sensors to detect dual subtractions. It is thereby assumed that diffused light, based on an illuminated letter, is brighter than diffused light during a dual subtraction. This method has a very high error rate because the letters normally have varying degrees of transparency.

Yet another solution is proposed in EP 0 650 911 B1 wherein at least one deflection element is placed within the hauling path, by which movable portions of the mail items are deflected temporarily vertically to the hauling direction. The presence of overlapping portions of mail items is then detected by a detection facility based on the spring-return mechanism of the rearward deflected (in hauling direction) portions of mail pieces. This solution is mostly independent from the condition of the surface of the mail pieces.

BRIEF SUMMARY OF THE INVENTION

An advantage of the present invention is to overcome the problems of the above set out solutions. Another advantage is to provide a system which may easily be integrated into existing mail sorting systems at reasonable costs and easy manufacturability. These and other advantages are provided by the present system and method for detecting overlapping mail pieces.

The present invention comprises a system for detecting overlapping in-coming mail pieces carried along a track, comprising: a deflecting element for deflecting said mail pieces, said deflecting element positioned within said track so as to engage said mail pieces, at least one light barrier comprising a beam source and a detector element, said beam source emitting a light beam directed at a detector element, said at least one light barrier positioned proximate to said deflecting element such that an in-coming mail piece deflected by said deflecting means interrupts said light beam, and determination means for determining if said light beam has been interrupted more than once within a time T defined by the relationship $T \leqq L/F$, wherein L is the approximate length of a deflected mail piece and F is the in-coming speed of the in-coming mail pieces.

The present invention further comprises a method for identifying an occurrence of an overlapping in-coming mail piece being conveyed along a track, comprising the steps of: determining a length of said mail piece; determining an in-coming speed of said mail piece; deflecting said mail piece; and determining if a first light barrier is broken during a time T defined by the relationship $T \leqq L/F$, wherein L is the approximate length of a deflected mail piece and F is the in-coming speed of the in-coming mail pieces.

Because mail items comprises varying lengths, it is insufficient to detect the overlaps only in the rear portions of mail items (with respect to the conveyance direction) by detection of short successively rotating rear edges. Overlaps may also occur when the rear edges of the stacked mail items are essentially superimposed and only the front edges are a bit offset. In such circumstances, the solution set out in EP 0 650 911 B1 becomes inoperative. For overcoming at least this deficiency, the present solution, as set out in the claims, deflects movable front portions of mail items away from the conveyance direction.

The present system may be placed on either or both sides of the conveyance path in so as to detect leading edges with respect to trailing edges and overlaps from either side.

In another embodiment, the present apparatus may comprise a rotating smooth disk for deflecting mail pieces. The disk may be positioned at an angle or diagonally to the on-coming mail pieces. Rotating speed of the disk may be selected to approximately match the conveyance rate.

In a further embodiment the disk includes a plurality of teeth separated by gaps, the teeth being arranged about the circumference of the disk and rotating at such a speed and direction that the teeth engage a leading edge of an in-coming mail piece and the gaps engage any subsequent overlapping mail pieces. An advantage to this embodiment includes avoiding deformations of the mail pieces.

In a still further embodiment, another rotating disk may be added so as to take the tension off of the deflected portions of the mail pieces.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

Figure 1A:
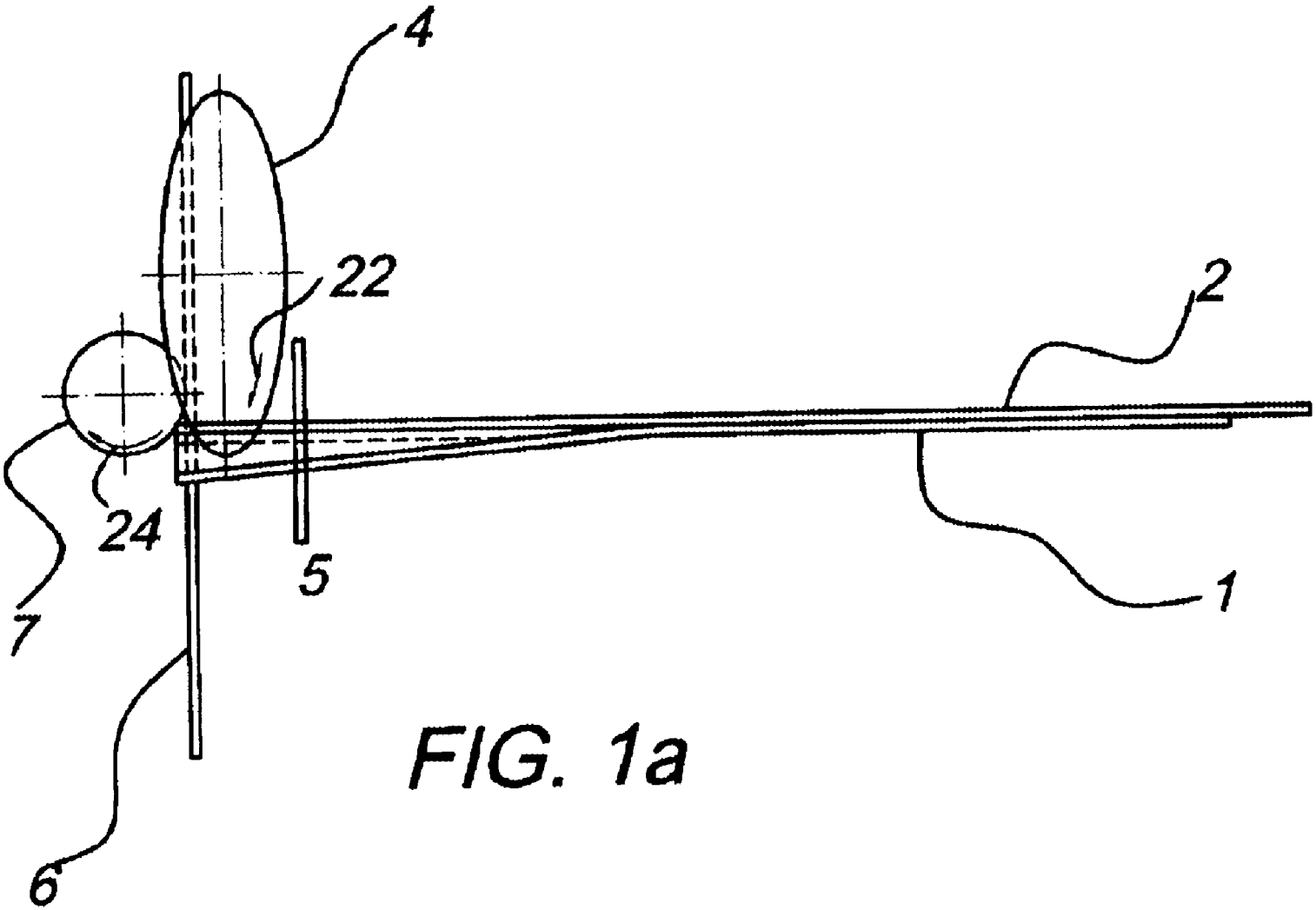
FIG. 1*a* depicts a bottom view of an embodiment according to the present invention.

FIG. 1 depicts a bottom view of an embodiment of the present invention. The depicted apparatus comprises a first disk 4 having a smooth circumference and positioned at an angle to in-coming mail pieces 1 and 2. First disk 4 is made to rotate in direction 22 (FIG. 1*a*) at a speed approximate to the speed of in-coming mail pieces by known means not depicted for clarity. Mail pieces 1 and 2 are depicted as overlapping. A second disk 7 is depicted positioned behind or downstream (with respect to the direction of the on-coming mail pieces 1 and 2) and at an angle to the first disk 4. Second disk 7 may be made to rotate in the direction 24 (FIG. 1*a*). First and second light barriers 5 and 6, respectively, are also depicted. Second light barrier 6 is positioned downstream (with respect to the conveyance direction of the in-coming mail) from the first light barrier 5. The present system may include only first light barrier 5 (also performing the function of light barrier 6, as will be detailed below) as well as alternate placements of the two light barriers, such as together or with the second light barrier leading the first. Appropriate reorientations of the herein discussed elements and functions would follow. Conveyance and drive means are not shown for purposes of clarity only.

The mail pieces as depicted are squeezed into an upright position between two cover bands in a cover band system. The cover bands only cover a small portion of the surfaces of the mail pieces being positioned upright, such that large amounts of surface above and below the bands are available and visible. Other conveyance schemes are applicable to the present invention provided that front edges of in-coming mail pieces are available for deflection (as will be detailed below).

Figure 1B:
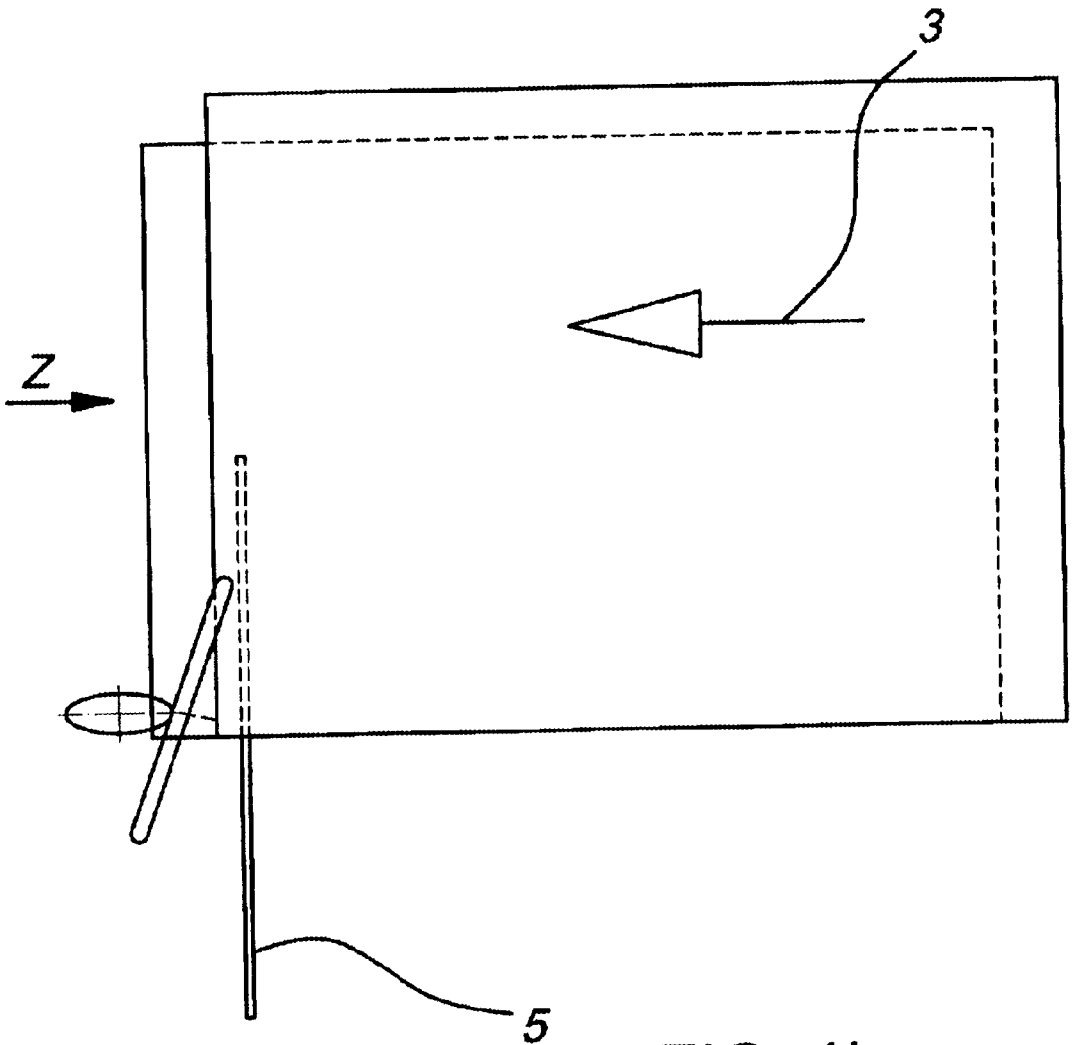
FIG. 1*b* depicts a side view of an embodiment according to the present invention.
Figure 1C:
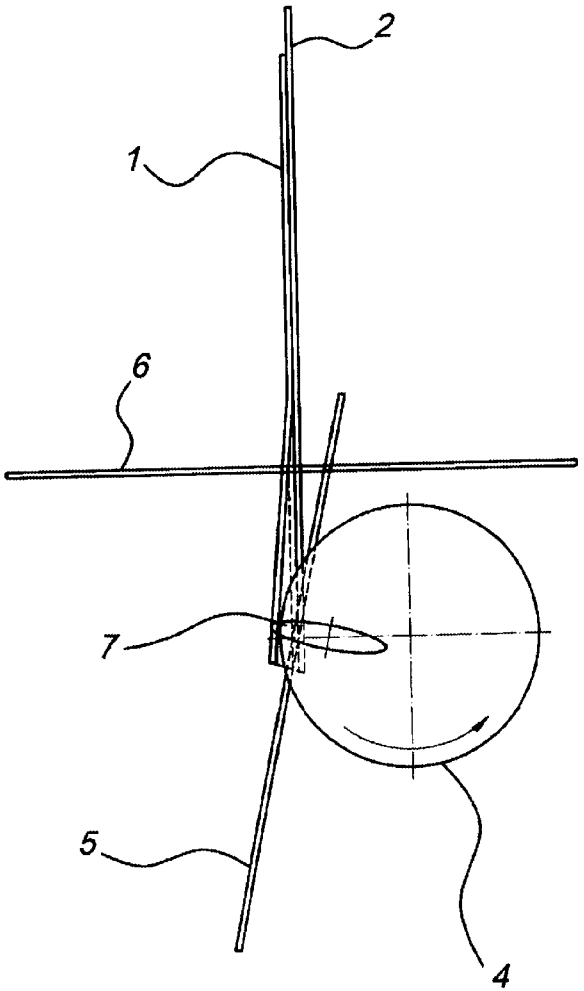
FIG. 1*c* depicts a perspective view an embodiment according to the present invention.
Figure 2:
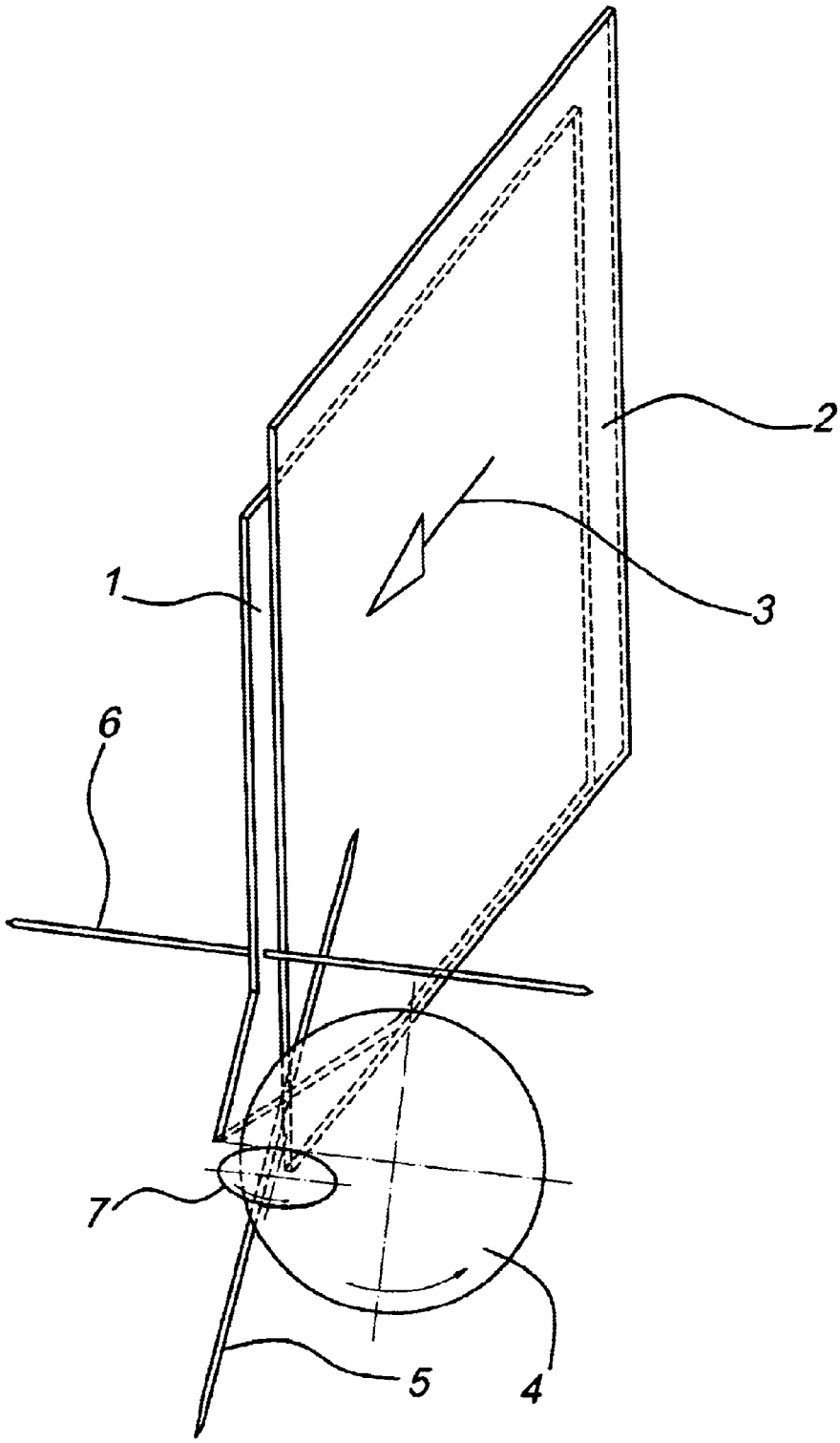
FIG. 2 depicts a front view an embodiment according to the present invention.

FIG. 1*b* depicts a top view of the present invention depicting, among other things, the direction 3 of the overlapping pieces. FIG. 1*c* depicts a perspective view wherein disks 4 and 7 are approximately perpendicular. FIG. 2 depicts a front view of the present embodiment. The operation of the present embodiment will now be described with general reference to the above cited figures.

In operation, the first disk 4 deflects a leading edge of a leading mail piece as it approaches the present system positioned along a conveyance system. The disk, by virtue of its angle to the in-coming mail and rotational speed, deflects the front edge of the mail piece, causing a redirection of the mail piece along the conveyance path. The deflected mail piece may be made to break light barrier 5, assuming the light barrier 5 is activated. This breaking will start a clock counting time 'T', to be detailed below. Alternatively, the leading front edge may be made or directed to break second light barrier 6 thereby activating light barrier 5 as well as starting 'T'. Second disk 7 assists with the continued conveyance of the diverted mail piece, along the track, by continuing to redirect the leading edge, as received from the second disks' cooperation with and placement to the first disk 4. Should an overlapping mail piece be present, in this case mail piece 2, the leading edge of mail piece 2 is also deflected as was the case with mail piece 1. The leading edge of mail piece 2 breaks light barrier 5 in the same manner as the leading edge of mail piece 1. The breaking of light barrier 5 within a certain time frame T is indicative of an overlap and so noted. As noted above, time frame T is counted beginning with the breaking of either light barrier 5 or 6 depending upon the arrangement. Time frame T is defined by the relationship $T \leqq L/F$, wherein L=approximate length of the deflected mail piece and F=hauling speed. An appropriately programmed and connected processor may be included with the present invention to facilitate the above calculations and operation.

The light barriers, as known in the art, may comprise a light source whose emissions are directed at a detector. As depicted, the light barriers are positioned approximately perpendicular, although their actual angular displacement to each other as well as to in-coming mail pieces is a matter of design provided the above functionality is respected. As is depicted, second light barrier 6 is positioned transversally to the direction of the mail pieces.

First disk 4 rotates in a direction and speed approximately the same as the in-coming mail pieces and is positioned at an angle so as to deflect the on-coming mail (see e.g. FIGS. 1*c* and 2). First disk 4 is positioned so as to engage a lower portion of the on-coming mail. Generally, this is below the conveyor bands or other conveying means used to haul the mail pieces along a certain plane and track. Accordingly, at least the first disk may be located within the track. In another embodiment, the disk may be positioned to grab and deflect any appropriate portion of the on-coming mail. First disk 4 deflects a front portion of the leading mail piece and therefore a second system may be located on the opposite side of the conveyor band or track in case a trailing edge is located along that side. For effective operation, a leading edge of a trailing overlapping mail piece must be available for deflection.

For the gentle treatment of the mail pieces 1, 2 the deflected portions of mail pieces may be taken over immediately after the deflection by second disk 4 for further conveyance in hauling direction 3.

Figure 3A:
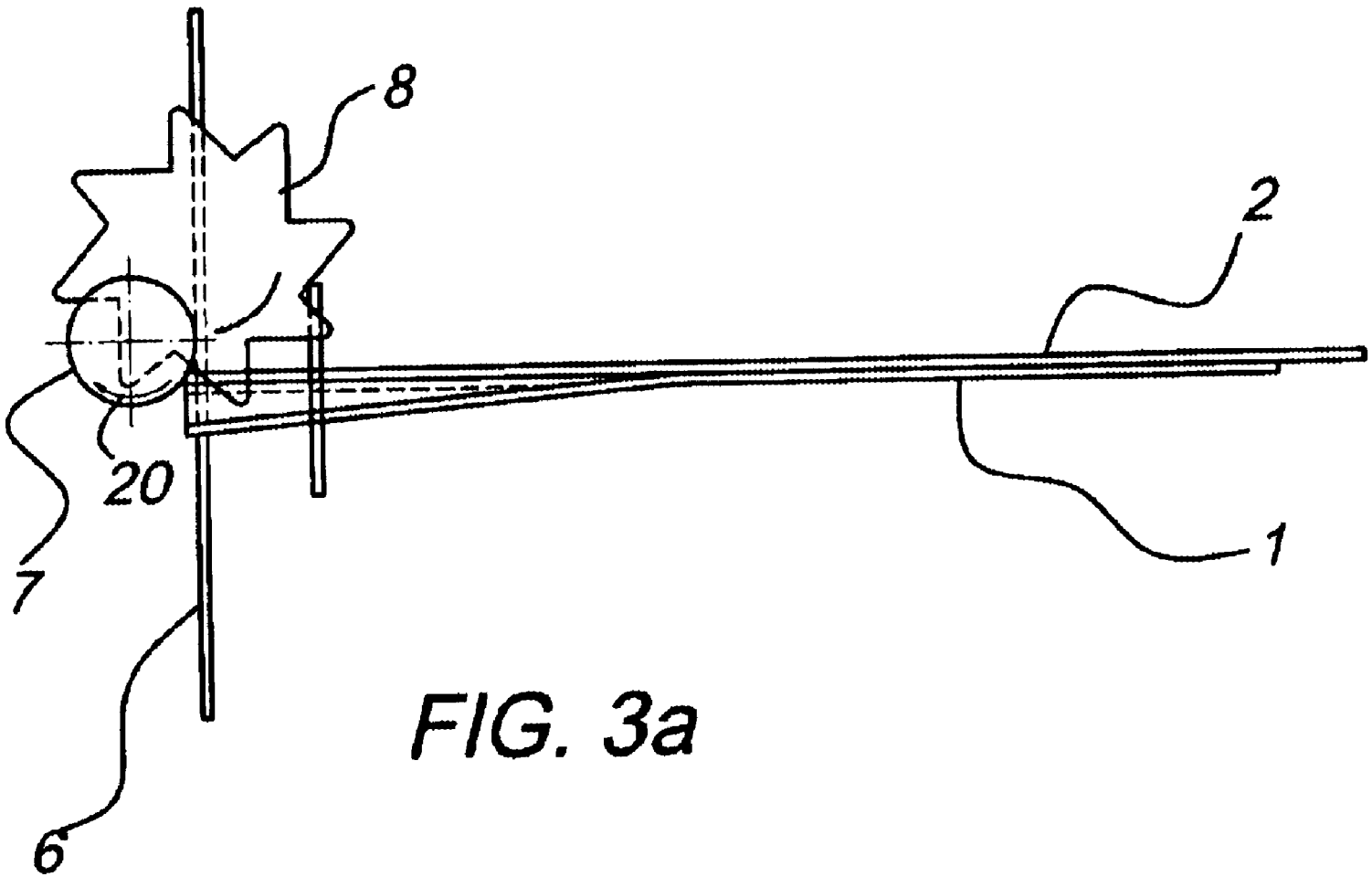
FIG. 3*a* depicts a bottom view of another embodiment according to the present invention.
Figure 3B:
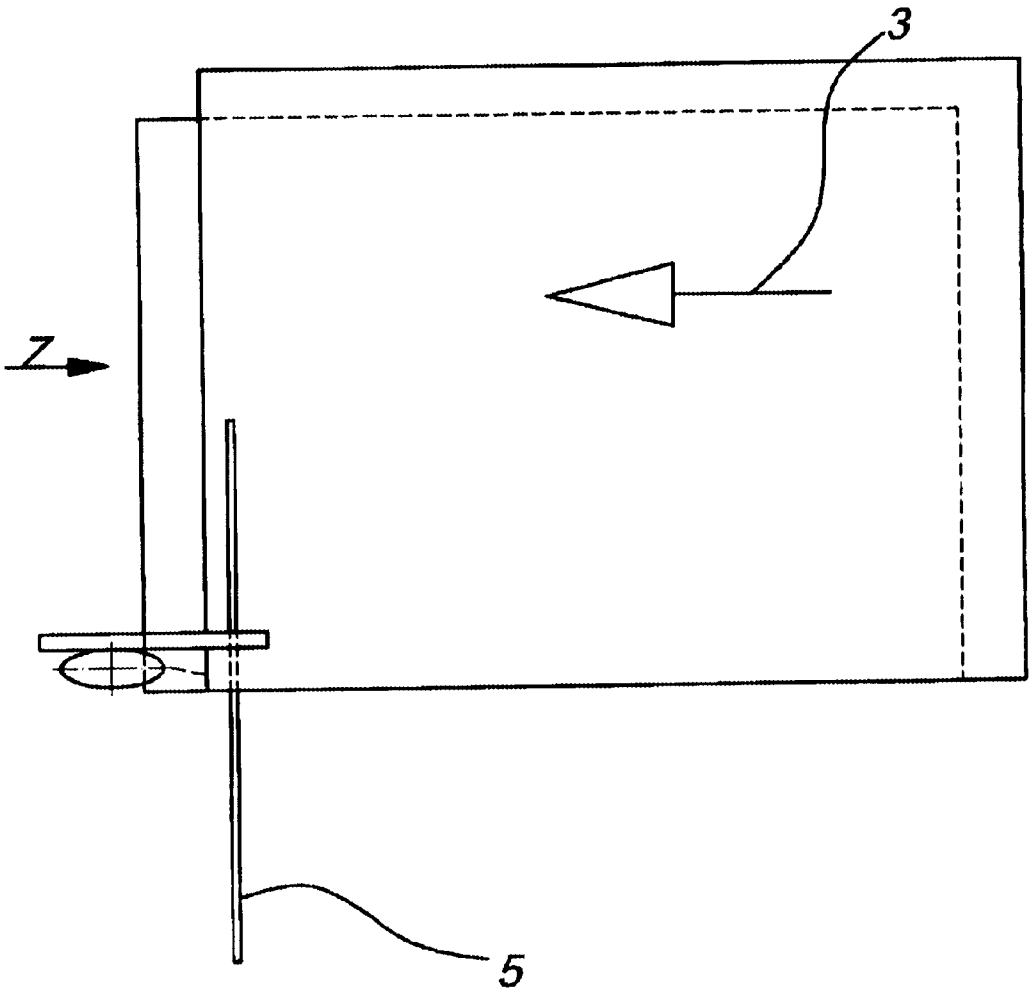
FIG. 3*b* depicts a side view of another embodiment according to the present invention.
Figure 3C:
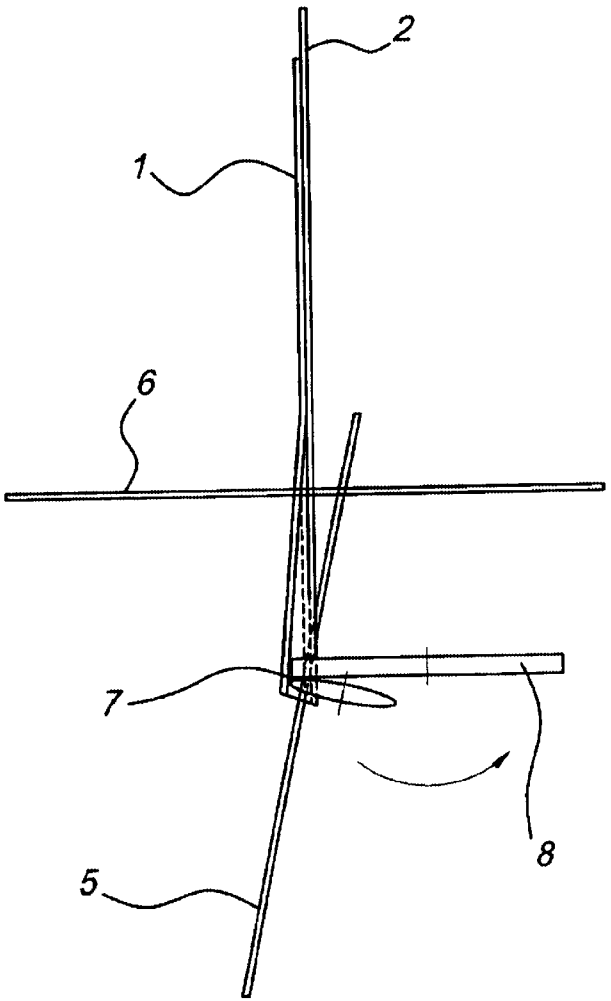
FIG. 3*c* depicts another side view of another embodiment according to the present invention.

Another embodiment of the present invention is depicted in FIGS. 3*a*–3*c*. Herein, first disk 4 from above is replaced by a third disk 8. Third disk 8 comprises a plurality of teeth separated by gaps or spaces and positioned along the circumference of the third disk. The third disk is positioned at a location and angle so as to engage the leading edge of an in-coming mail piece as described above with respect to the first disk 4. The third disk 8 is made to rotate in direction 20 (FIG. 3*a*) by means known in the art and not shown for purposes of clarity. The remaining elements of this embodiment remain at least equivalent to the embodiment set out above. In operation, the third disk is made to rotate such that the leading edge of an in-coming mail piece is deflected by a tooth, while the leading edge of a trailing and overlapping mail piece is accommodated within a space or gap. Deflection of the trailing and overlapping mail piece occurs by a subsequent tooth. The operation is otherwise at least equivalent to the above described operation.

The invention being thus described, it will be obvious that the same may be varied in many ways. Such variations may include a mixing of elements from the above embodiments. Such variations are not to be regarded as a departure from the spirit and scope of the invention, and all such modifications as would be obvious to one skilled in the art are intended to be included within the scope of the following claims.

I claim:

1. A system for detecting overlapping in-coming mail pieces conveyed along a track, comprising:

a deflecting element for deflecting said mail pieces, said deflecting element positioned within said track so as to engage said mail pieces, at least one light barrier comprising a beam source and a detector element, said beam source emitting a light beam directed at a detector element, said at least one light barrier positioned proximate to said deflecting element such that an in-coming mail piece deflected by said deflecting means interrupts said light beam, and determination means for determining if said light beam has been interrupted more than once within a time T defined by a relationship $T \leqq L/F$, wherein L is an approximate length of a deflected mail piece and F is an in-coming speed of said in-coming mail pieces.

2. The system according to claim 1, wherein said system is duplicated and located on opposite sides of said track.

3. The system according to claim 1, wherein said deflecting element comprises a first disk having a smooth circumference and positioned at an angle to said mail pieces, said first disk rotating in a direction such that a front edge of a leading mail piece is engaged by and deflected from its path by said first disk.

4. The system according to claim 3, wherein said first disk rotates at a speed approximate to an in-coming speed of said mail pieces.

5. The system according to claim 4, further comprising a second disk for engaging a deflected mail piece.

6. The system according to claim 1, wherein said deflecting element comprises a third disk including a plurality of teeth separated by gaps, said teeth being located about a circumference of said first disk and positioned to deflect a front edge of a leading mail piece, and said gaps positioned to engage a trailing mail piece within said time T.

7. The system according to claim 6, wherein said third disk rotates at a speed approximate to an in-coming speed of said mail pieces.

8. The system according to claim 7, further comprising a second disk for further engaging a deflected mail piece.

9. The system according to claim 1, further comprising a second light barrier positioned downstream from said first light barrier with respect to a direction of said incoming mail pieces, said second light barrier connected to switching means for engaging said first light barrier when said second light barrier is broken by an in-coming mail piece.

10. The system according to claim 1, further comprising a second light barrier positioned downstream from said first light barrier with respect to a direction of said incoming mail pieces, said second light barrier connected to said determination means thereby providing said determination means with an indication of when T begins, said indication originating when said second light barrier is broken by an in-coming mail piece.

11. A method for identifying an occurrence of an overlapping in-coming mail piece being conveyed along a track, comprising the steps of:

determining a length of said mail piece;

determining an in-coming speed of said mail piece;

deflecting said mail piece; and determining if a first light barrier is broken during a time T defined by a relationship $T \leqq L/F$, wherein L is an approximate length of a deflected mail piece and F is said in-coming speed.

12. The method according to claim 11, further comprising the steps of:

providing a second light barrier downstream with respect to a direction of in-coming mail pieces to said first light barrier, said second light barrier providing an indication of when T begins, said indication occurring when said second light barrier is broken.

13. The method according to claim 11, wherein said deflecting is facilitated by a first disk.

14. The method according to claim 13, wherein said first disk comprises a smooth circumference, is positioned to deflect a front edge of a leading mail piece, and rotates at a speed approximate to an incoming speed of said mail pieces.

15. The method according to claim 13, wherein said first disk comprises a plurality of teeth separated by gaps, said teeth positioned about a circumference of said disk, and positioned to deflect a front edge of a leading mail piece, and said gaps positioned to engage a trailing mail piece within said time T.

16. The method according to claim 13, further comprising a second disk for engaging deflected mail pieces and facilitating continued routing of said mail pieces along said track.

* * * * *